US006552480B1

(12) United States Patent
Ohmae et al.

(10) Patent No.: US 6,552,480 B1
(45) Date of Patent: Apr. 22, 2003

(54) COLOR CATHODE-RAY TUBE

(75) Inventors: Hideharu Ohmae, Osaka (JP); Susumu Okuji, Osaka (JP); Makoto Okuji, Nara (JP)

(73) Assignee: Matsushita Electric Co., Ltd., Kadoma (JP)

( * ) Notice: Subject to any disclaimer, the term of this patent is extended or adjusted under 35 U.S.C. 154(b) by 360 days.

(21) Appl. No.: 09/712,451

(22) Filed: Nov. 14, 2000

(30) Foreign Application Priority Data

Nov. 19, 1999 (JP) ..... 11-329440

(51) Int. Cl.[7] ..... H01J 29/80
(52) U.S. Cl. ..... 313/407; 313/402; 313/408
(58) Field of Search ..... 313/402, 407, 313/408

(56) References Cited

U.S. PATENT DOCUMENTS 5,416,380 A 5/1995 Horiuchi ..... 313/407
5,532,546 A * 7/1996 Horiuchi ..... 313/407
5,751,098 A * 5/1998 Ito et al. ..... 313/402
5,834,886 A * 11/1998 Jeong et al. ..... 313/402

FOREIGN PATENT DOCUMENTS

JP 6-246302 9/1994

* cited by examiner

*Primary Examiner*—Robert H. Kim
*Assistant Examiner*—Jurie Yun
(74) *Attorney, Agent, or Firm*—Merchant & Gould, P.C.

(57) ABSTRACT

In a color cathode-ray tube with a shadow mask stretched and held by supporters while being provided with a tensile force, a member with a substantially L-shaped cross-section is used for each of the supporters, which is obtained by forming of a strip plate material having a middle part and thinner thickness-deviation portions on both sides of the middle part by rolling of a metal material; and then bending and deforming of the strip plate material in its width direction by roll forming to form a bent and deformed portion in the middle part. The supporter obtained by such a method can be reduced in weight while maintaining substantially the same strength as that of a conventional product, can be processed economically in relatively simple steps, and has less thickness variation. Therefore, an inexpensive color cathode-ray tube having stable qualities and causing less color unevenness can be provided.

16 Claims, 16 Drawing Sheets

COLOR CATHODE-RAY TUBE

BACKGROUND OF THE INVENTION

1. Field of the Invention

The present invention relates generally to a color cathode-ray tube. Particularly, the present invention relates to a color cathode-ray tube including a shadow mask stretched and held while being provided with a tensile force.

2. Related Background Art

In a color cathode-ray tube, a phosphor screen formed on an inner face of a face panel is irradiated with electron beams emitted from an electron gun, thus displaying a desired image. On the electron gun side of the phosphor screen, a shadow mask functioning as a color selection electrode is provided at a predetermined distance from the phosphor screen. In the shadow mask, a number of openings (electron beam through holes) are formed and arranged so that the electron beams strike phosphors at predetermined positions.

When the electron beams strike the shadow mask, the shadow mask expands thermally. This causes displacement of the openings and therefore the electron beams that have passed through the openings no longer strike the phosphors at predetermined positions properly, thus causing color unevenness. Such a phenomenon is called "doming". In order to prevent this, the shadow mask is stretched and held by a mask frame while being provided with a tensile force that can absorb thermal expansion caused by the temperature increase. Therefore, the relative position shift between the openings of the shadow mask and phosphor stripes formed on the phosphor screen can be reduced even when the temperature of the shadow mask rises.

The mask frame is constructed by assembly of iron members including a pair of opposed supporters for stretching the shadow mask to have a substantially rectangular frame shape. Each supporter has a substantially L-shaped cross-section and the shadow mask is stretched at one end of the supporter in its width direction. In order to apply a predetermined tensile force to the shadow mask, the supporters are required to have sufficient strength for resisting the tensile force.

In this connection, methods conventionally used for manufacturing such supporters include, for example, a method of bending a strip-like iron plate with a predetermined thickness by press processing or roll forming so that the iron plate has a substantially L-shaped cross section with its corner at substantially the center in its width direction, a method of drawing an iron material using a die with a substantially L-shaped opening, or the like.

However, in the method of bending an iron plate by press processing or roll forming, an inner side of a corner formed by the bending is recessed during bending, thus causing the reduction in wall thickness of the corner, which is a phenomenon of a so-called "thickness loss". When the corner of a stress concentration part is subjected to the thickness loss, the strength of the supporter is lowered and thus a desired tensile force cannot be applied to the shadow mask. In order to apply a desired tensile force, it is required to use a thick strip-like iron plate with consideration to the thickness loss during processing, thus increasing weight and cost.

In addition, when a hot rolled steel sheet is used as a strip-like iron plate for the raw material, it has a great unevenness in thickness and therefore a greatly uneven tensile force is applied to the shadow mask. Consequently, a cathode-ray tube with a stable quality cannot be obtained. When the hot rolled steel sheet is subjected to cold rolling before the bending process, the unevenness in thickness is reduced, but the number of steps increases, thus increasing the cost.

On the other hand, in the drawing process, it is difficult to obtain a thin member with a substantially L-shaped cross-section. When the member is thick, it is difficult to obtain a desired tensile force and the weight and the cost increase.

The increase in the weight of the supporters increases the weight of a mask structure formed of the shadow mask to be stretched and the mask frame. As a result, deformation of elastic supporters for holding the mask structure with respect to the face panel increases. In addition, the elastic supporters tend to be deformed permanently due to shocks from the outside or the like. Any of the above-mentioned deformations can cause color unevenness.

SUMMARY OF THE INVENTION

It is an object of the present invention to solve the above-mentioned conventional problems in a color cathode-ray tube with a shadow mask stretched and held while being provided with a tensile force. In other words, the present invention is intended to provide an inexpensive color cathode-ray tube having a stable quality and causing less color unevenness, which is obtained using supporters with stable qualities that can apply a desired tensile force to a shadow mask without causing the increases in weight and cost.

In order to achieve the above-mentioned object, the following configurations are employed.

A color cathode-ray tube of a first configuration of the present invention includes a mask frame and a shadow mask functioning as a color selection electrode. The mask frame includes at least a pair of opposed supporters and is formed in a substantially rectangular frame shape. The shadow mask is stretched and held by the supporters while being provided with a tensile force. Each of the supporters is a member with a substantially L-shaped cross-section and is obtained by the forming of a strip plate material having a middle part and thinner thickness-deviation portions on both sides of the middle part by rolling of a metal material and then bending and deforming of the strip plate material in its width direction by roll forming to form a bent and deformed portion in the middle part.

A color cathode-ray tube of a second configuration of the present invention includes a mask frame and a shadow mask functioning as a color selection electrode. The mask frame includes at least a pair of opposed supporters and is formed in a substantially rectangular frame shape. The shadow mask is stretched and held by the supporters while being provided with a tensile force. Each of the supporters is a member with a substantially L-shaped cross-section and is obtained by the forming of a strip plate material by rolling of a metal material, the strip plate material having a middle part, thinner thickness-deviation portions on both sides of the middle part, and a thick stripe portion at a predetermined position in the middle part corresponding to an outer corner of a bent and deformed portion to be formed, and then bending and deforming of the strip plate material in its width direction at a position of the thick stripe portion by roll forming to form the bent and deformed portion.

According to the methods of processing the supporters according to the first and second configurations, the bent and deformed portion obtained by the roll forming has at least the same thickness as an original thickness of the metal material, and the thickness-deviation portions positioned on both sides of the bent and deformed portion are formed to be thin in the rolling step prior to the roll forming. Therefore, the supporters of the present invention can be reduced in weight while maintaining substantially the same strength as that of a conventional supporter with a substantially L-shaped cross-section.

Since the process includes the rolling step and the roll forming step, the processing can be carried out economically in relatively simple steps.

Even if the metal material has unevenness in thickness, the unevenness is corrected during the formation of the thickness-deviation portions in the rolling step, thus unifying the thickness. Therefore, an inexpensive hot roll steel sheet can be used, thus obtaining supporters with stable qualities at a low cost.

Consequently, the shadow mask is stretched and held using the above-mentioned supporters while being provided with a tensile force, thus providing an inexpensive color cathode-ray tube having stable qualities and causing less color unevenness.

The quality and shape of the metal material as a raw material of the supporters are not particularly limited as long as the metal material is a steel material or the like suitable for plastic processing.

In the rolling step for forming the strip plate material from the metal material, the thickness-deviation portions may be formed to be reduced in thickness gradually from the middle part toward the ends of side portions positioned on both sides of the middle part. Furthermore, at a predetermined position in the middle part corresponding to an outer corner of a bent and deformed portion to be formed, a thick stripe portion is formed suitably. The thick stripe portion may be formed of one stripe, but also may be formed of two adjacent protruding stripes extending continuously along the length direction in the middle part of the strip plate material, with the portion between the two protruding stripes being recessed in an arc shape.

For the rolling of the metal material, warm rolling can be employed. Preferably, however, rolling under ordinary temperature (cold rolling) is employed and the next step of roll forming is carried out while processing heat generated during the rolling still remains in the strip plate material. In other words, the rolling step and the roll forming step are carried out successively, and therefore the roll forming can be carried out with high efficiency using the processing heat generated during the rolling.

The strip plate material having the middle part formed to be thicker than the thickness-deviation portions is bent and deformed at a position of the middle portion in its width direction by roll forming, thus forming the bent and deformed portion. Thus, a desired supporter with a substantially L-shaped cross-section is obtained.

It also is possible that the above-mentioned rolling step and roll forming step are not carried out as two separate steps but concurrently at substantially the same time.

A color cathode-ray tube with a third configuration of the present invention includes a mask frame and a shadow mask functioning as a color selection electrode. The mask frame includes at least a pair of opposed supporters and is formed in a substantially rectangular frame shape. The shadow mask is stretched and held by the supporters while being provided with a tensile force. Each of the supporters is a member with a substantially L-shaped cross-section and is obtained by a process in which while thinner thickness-deviation portions are formed on both sides of a middle part of a metal material by rolling of the metal material, the metal material is bent and deformed in its width direction by roll forming to form a bent and deformed portion in the middle part.

A color cathode-ray tube with a fourth configuration of the present invention includes a mask frame and a shadow mask functioning as a color selection electrode. The mask frame includes at least a pair of opposed supporters and is formed in a substantially rectangular frame shape. The shadow mask is stretched and held by the supporters while being provided with a tensile force. Each of the supporters is a member with a substantially L-shaped cross-section and is obtained by a process in which while rolling of a metal material to form thinner thickness-deviation portions on both sides of a middle part of the metal material and a thick stripe portion at a predetermined position in the middle part corresponding to an outer corner of a bent and deformed portion to be formed, the metal material is bent and deformed in its width direction at a position of the thick stripe portion by roll forming to form the bent and deformed portion.

Even when the metal material is bent and deformed by roll forming while the thickness-deviation portions (and further the thick stripe portion as required) are formed by rolling as in the third and fourth configurations, the same effects as in the first and second configurations can be obtained. Moreover, according to the third and fourth configurations, the forming steps can be simplified and the processing heat generated during the rolling can be used for the roll forming effectively, thus improving formation efficiency.

In the first to fourth configurations described above, the supporter may have a tapered face and/or a protruding portion formed at an end in its width direction. In this case, preferably, the tapered face and/or the protruding portion are/is formed by the rolling or the roll forming. Conventionally, when the tapered face and/or the protruding portion are/is formed at an end, an independent step other than the step of forming the bent and deformed portion was necessary. On the other hand, in the present invention, the tapered face and/or the protruding portion also can be formed in the rolling step or the roll forming step, thus simplifying the steps.

Furthermore, in the above-mentioned first to fourth configurations, the pair of supporters may form long sides of the mask frame and the shadow mask may be provided with a tensile force in its short-side direction.

DETAILED DESCRIPTION OF THE INVENTION

The present invention is described with reference to the drawings as follows.

FIRST EMBODIMENT

Figure 1:
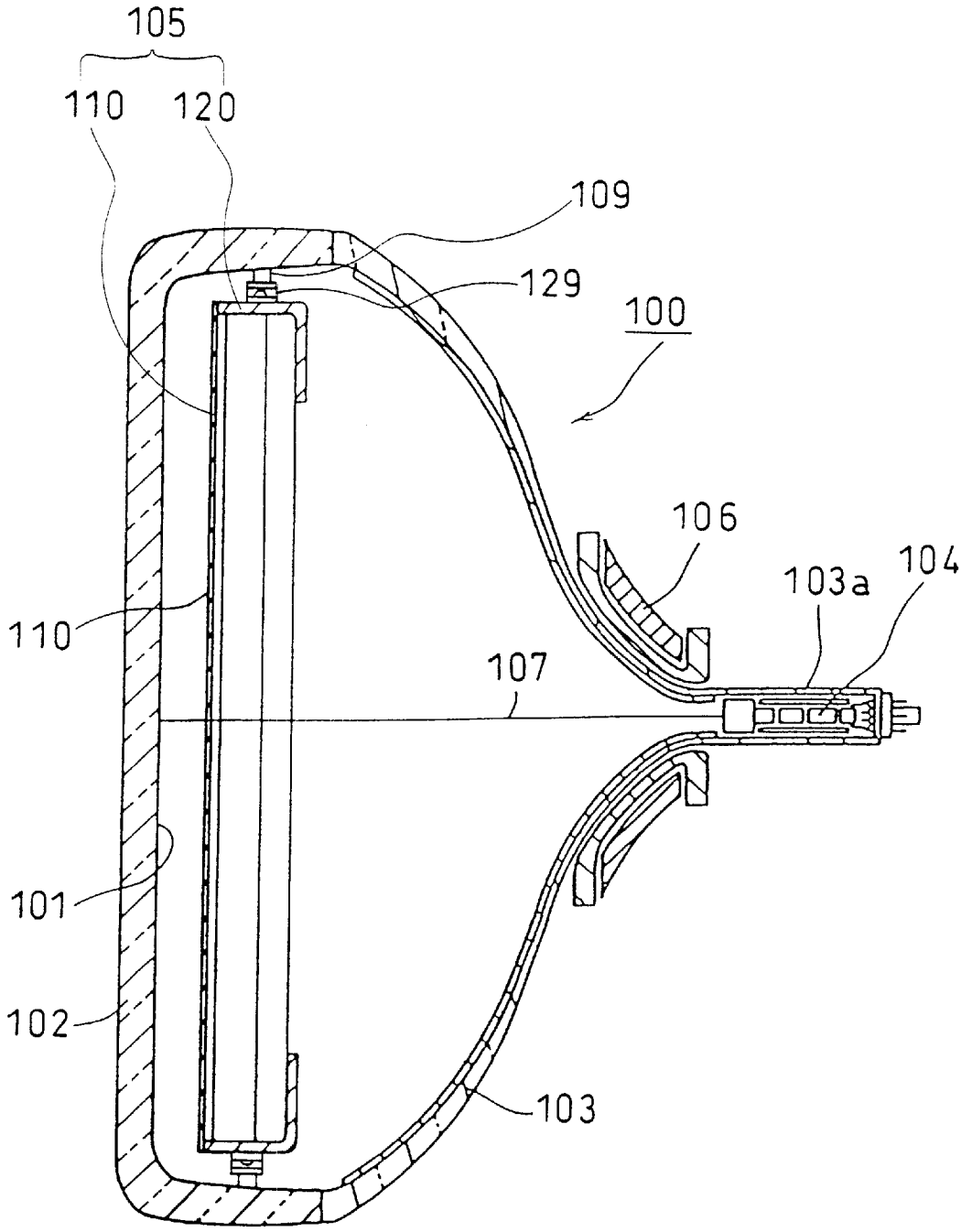
FIG. 1 is a schematic sectional view of a color cathode-ray tube according to the present invention.

FIG. 1 is a schematic sectional view of a color cathode-ray tube according to a first embodiment.

As shown in the figure, a color cathode-ray tube 100 includes a substantially rectangular face panel 102 with a phosphor screen face 101 formed on its inner face, a funnel 103 connected to the rear part of the face panel 102, an electron gun 104 built in a neck portion 103*a* of the funnel 103, a shadow mask 110 provided opposing the phosphor screen face 101 on the inner side of the face panel 102, and a mask frame 120 for stretching and holding the shadow mask 110. The mask frame 120 is held by the face panel 102 with flat-spring-like elastic supporters 129 provided on the outer peripheral surfaces of the mask frame 120 and are held by panel pins 109 partially embedded in the inner surface of the face panel 102. On the outer peripheral surface of the funnel 103, a deflection yoke 106 is provided for deflecting an electron beam 107 for scanning.

Figure 2:
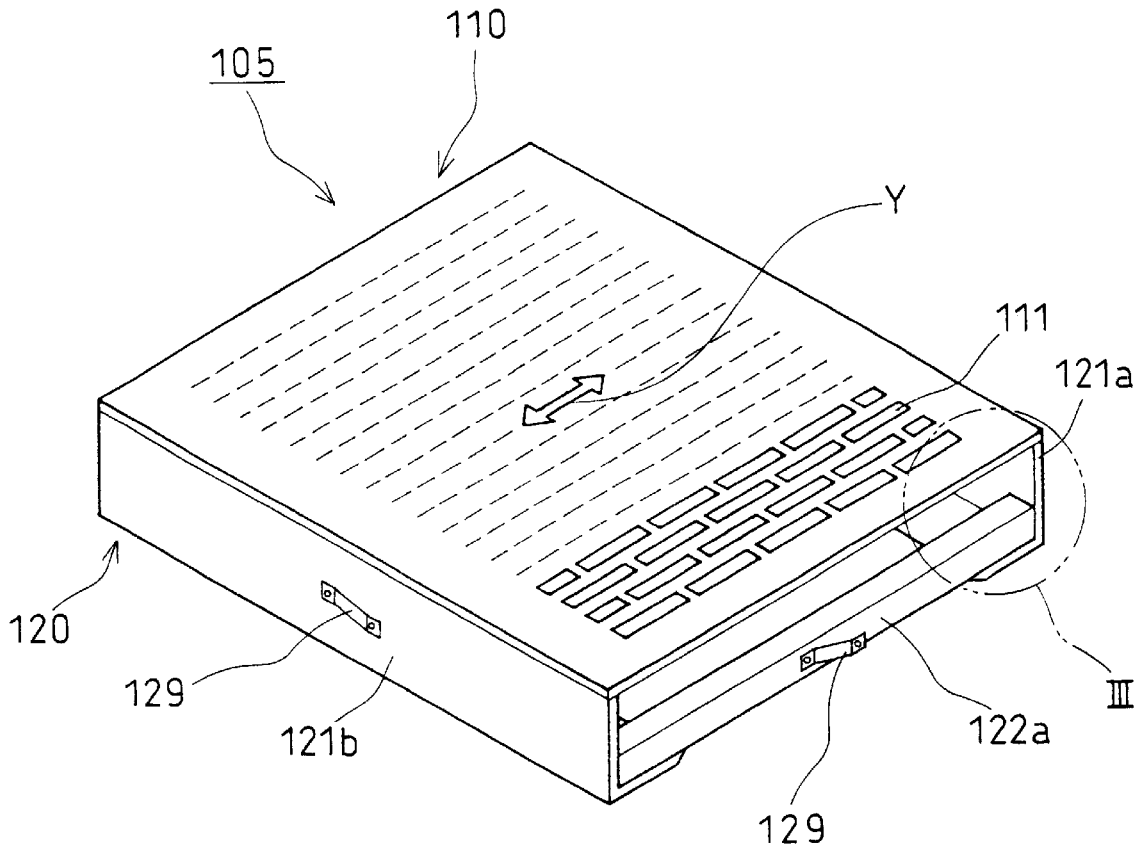
FIG. 2 is a schematic perspective view of a mask structure used in a color cathode-ray tube according to a first embodiment of the present invention.

FIG. 2 is a perspective view showing a schematic configuration of a mask structure 105 with a shadow mask 110 stretched and held by a mask frame 120.

The mask frame 120 includes a pair of supporters 121*a* and 121*b* with a substantially L-shaped cross section forming long sides of the frame 120 and a pair of fixing members 122*a* and 122*b* (the fixing member 122*b* is not shown in the figure) with a hollow rectangular tube shape forming short sides. The supporters 121*a* and 121*b* are positioned to oppose each other and the fixing members 122*a* and 122*b* also are arranged to oppose each other. They are combined in a substantially rectangular frame shape and are welded at their respective attachment portions. Elastic supporters 129 are fixed to the outer peripheral faces of the supporters 121*a*, 121*b* and the fixing members 122*a*, 122*b* so that the shadow mask structure 105 is held by the panel pins 109 (see FIG. 1) of the face panel.

The shadow mask 110 has a substantially rectangular shape and the side ends of its long sides are welded to free side ends of the supporters 121*a* and 121*b*. In this case, the shadow mask 110 is welded and fixed while external forces in directions in which the pair of supporters 121*a* and 121*b* approach each other are applied to the free side ends of the pair of supporters 121*a* and 121*b*. Thus, the shadow mask 110 is stretched while a tensile force is applied in the direction Y parallel to the short sides as shown in the figure. In the shadow mask 110, a number of substantially rectangular openings 111 as electron beam through holes are formed, for example, by etching.

Figure 3:
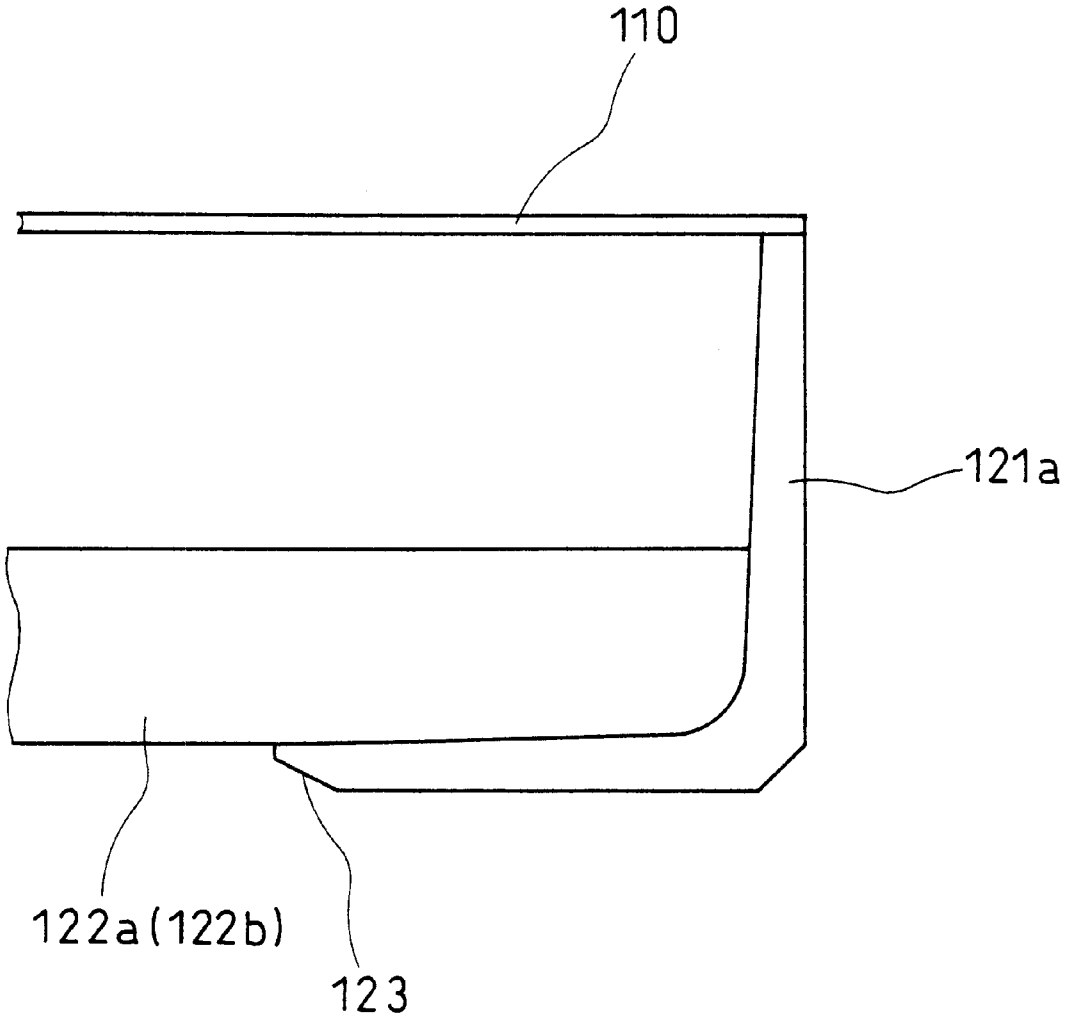
FIG. 3 is an enlarged side view of a portion III shown in FIG. 2.

FIG. 3 shows an enlarged side view of the part III shown in FIG. 2. The supporter 121*a* has a tapered face (a slope) 123 formed at the opposite end to the end to which the shadow mask 110 is fixed. The tapered face 123 is provided so as to chamfer the end on the opposite side to the shadow mask 110 side, i.e. on the electron gun side. When an electron beam emitted from the electron gun strikes the end of the supporter 121*a*, the tapered face 123 allows the electron beam to be reflected to the electron gun side, thus preventing the electron beam from entering the shadow mask 110 side (an electron shield function of the tapered face 123). FIG. 3 shows the tapered face of the supporter 121*a* alone, but the same tapered face also is formed in the supporter 121*b*.

Next, the following description is directed to a method of manufacturing the supporters 121*a* and 121*b* used in the color cathode-ray tube according to the present embodiment.

Figure 4:
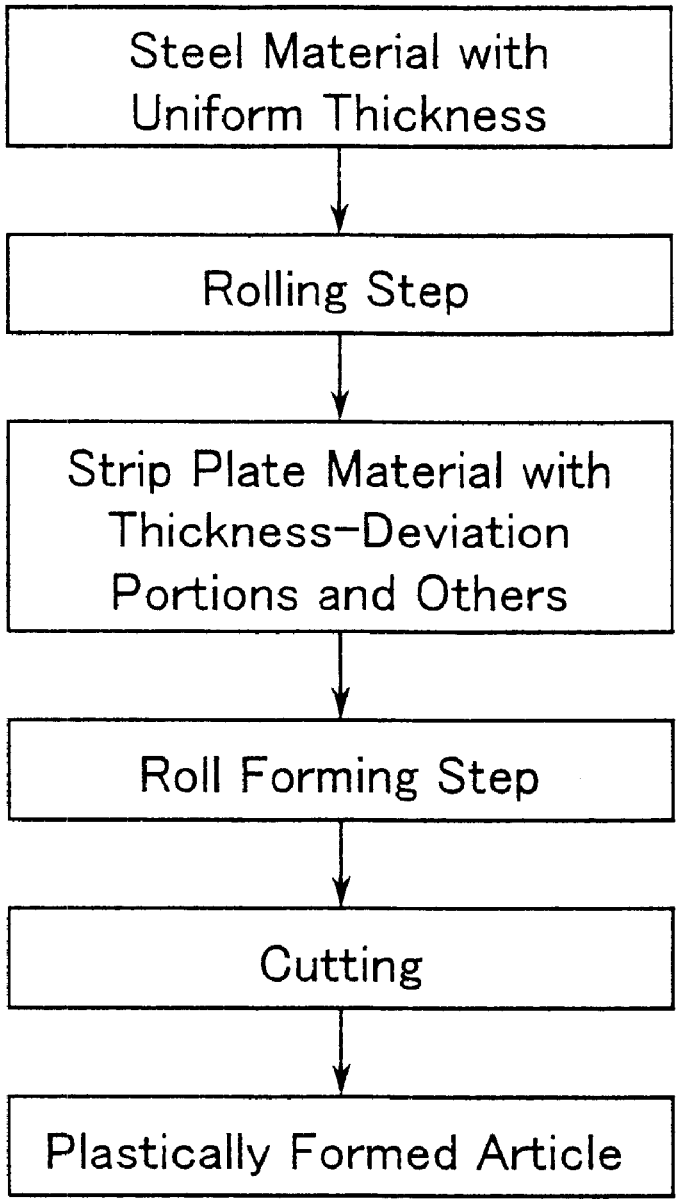
FIG. 4 is a block diagram showing a method of processing a supporter used in the color cathode-ray tube according to the present invention.

FIG. 4 is a block diagram showing steps for manufacturing the supporters according to the first embodiment. As shown in the figure, a strip-like steel material with a substantially uniform thickness is processed by rolling to obtain a strip plate material, which further is processed by roll forming, thus obtaining the supporters.

Figure 5:
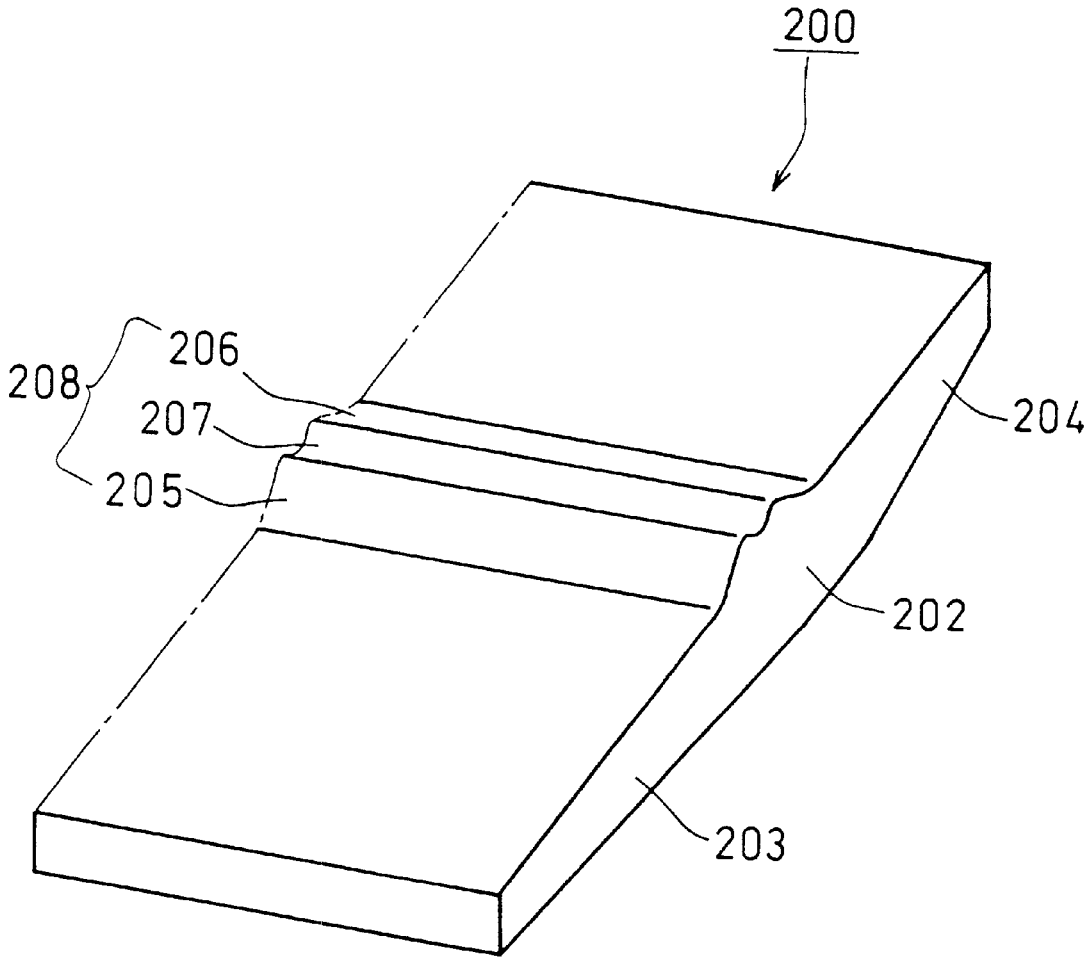
FIG. 5 is a perspective view of a strip plate material according to the first embodiment of the present invention.

FIG. 5 is a perspective view of a strip plate material formed in a rolling step.

This strip plate material 200 is formed of a strip-plate-like steel sheet and includes a middle part 202 to be bent and deformed and thickness-deviation portions 203, 204 with nonuniform thickness extending to the left and right continuously from the middle part 202. In the middle part 202, a thick stripe portion 208 with two protruding stripes 205, 206 is formed on the upper surface shown in FIG. 5. The thick stripe portion 208 is provided in a location corresponding to an outer corner to be formed later by bending and deformation and is continuously formed in the longitudinal direction. Between the two protruding stripes 205, 206, an arc-shaped recessed portion 207 is formed. The recessed portion 207 is at a higher level than that of the upper surfaces of the thickness-deviation portions 203, 204 of the steel plate.

The thickness-deviation portions 203, 204 are formed to be reduced in thickness gradually and slightly from the middle part 202 toward the left and right side ends of the strip plate material so as to have lower surfaces shown in FIG. 5 sloped in directions approaching their upper surfaces, respectively.

This strip plate material 200 is obtained as follows. Rollers are brought into contact with the upper and lower surfaces and the left and right side ends of a steel plate with a generally uniform thickness as a raw material from the four directions, so that the thickness-deviation portions 203, 204 and the thick stripe portion 208 are formed while the steel plate passes between the rollers.

Figure 8:
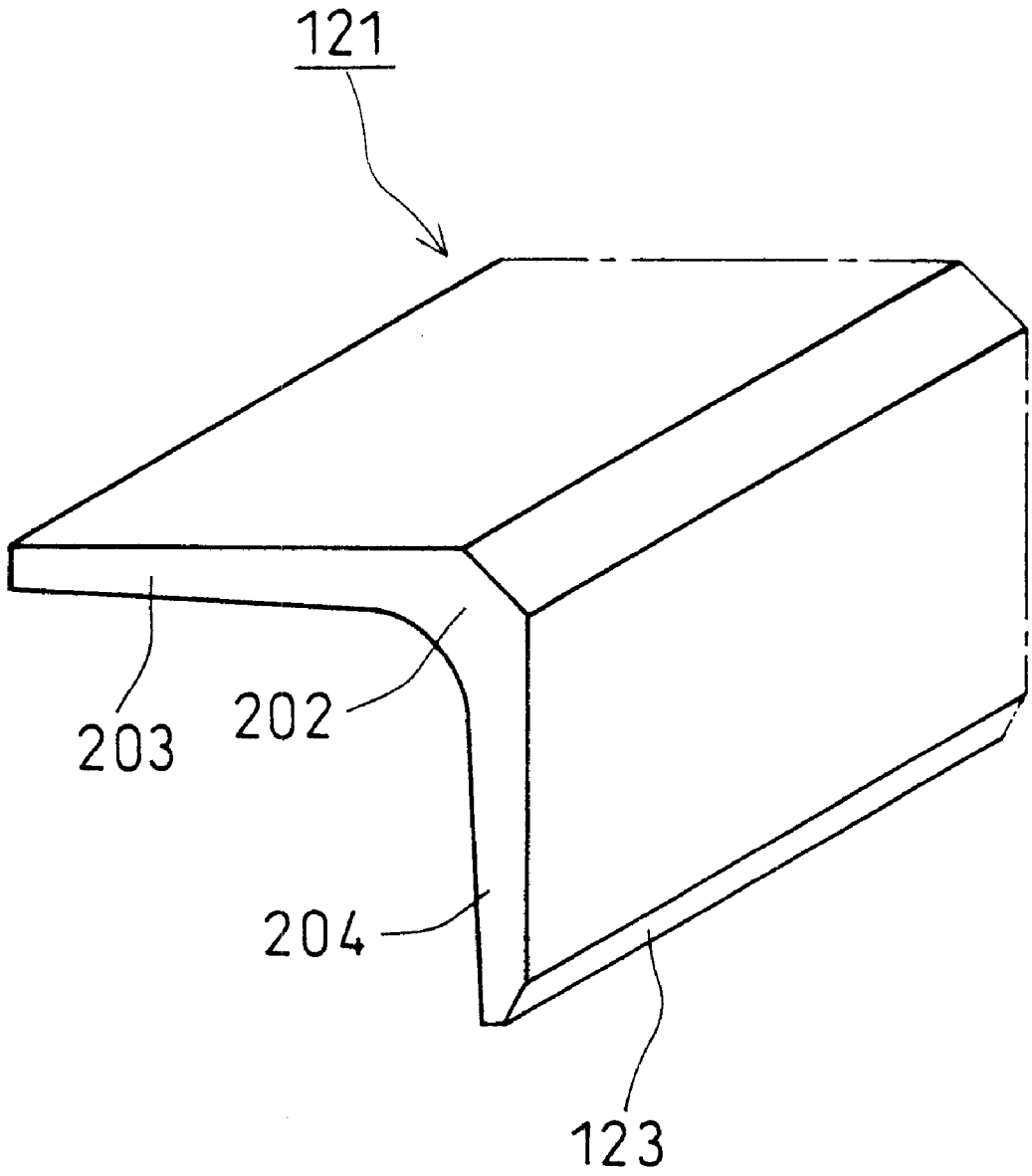
FIG. 8 is a perspective view showing a supporter obtained after completion of roll forming according to the first embodiment of the present invention.

After that, the strip plate material 200 is bent and deformed by roll forming so as to have the middle part 202 as a bent portion. The strip plate material 200 is bent and deformed with the thick stripe portion 208 being positioned outside, and then is cut to have a predetermined length, thus obtaining a supporter 121 with a substantially L-shaped cross-section shown in FIG. 8.

Preferably, the roll forming step is carried out successively to the rolling step. Since processing heat is generated in the strip plate material 200 by the rolling, bending and plastic deformation carried out by the roll forming while the processing heat still remains allow the strip plate material 200 to be bent with relative ease and high efficiency.

Figure 6:
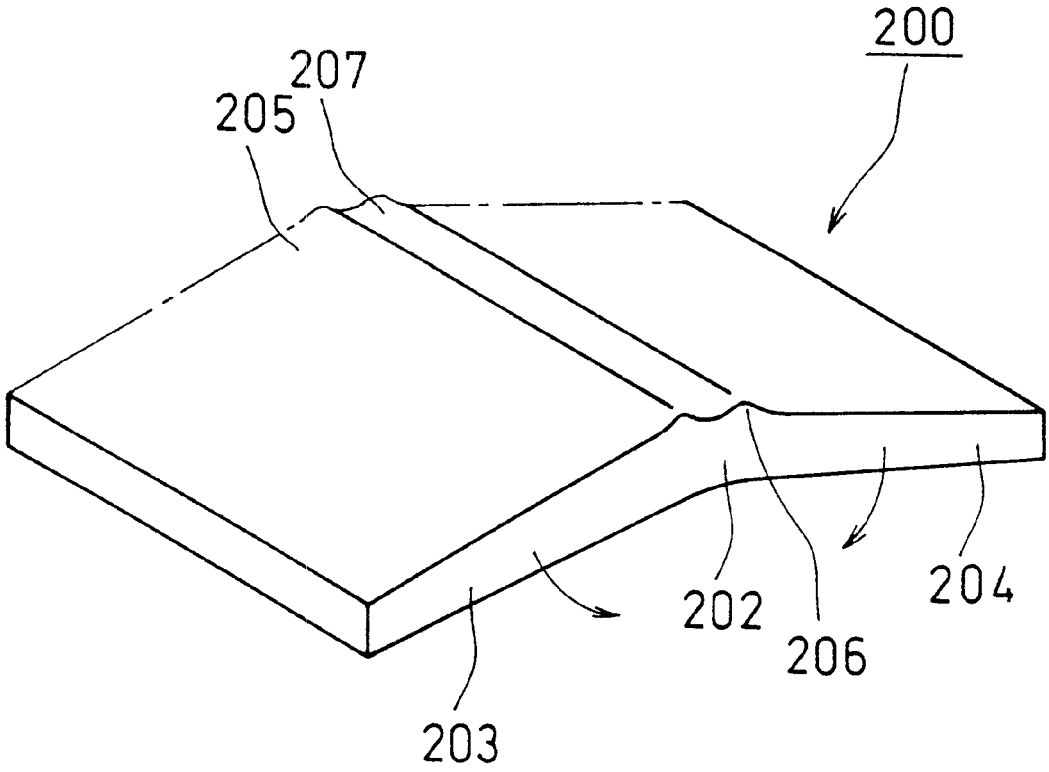
FIG. 6 is a perspective view showing a state where the strip plate material shown in FIG. 5 is bent and deformed by roll forming.
Figure 7:
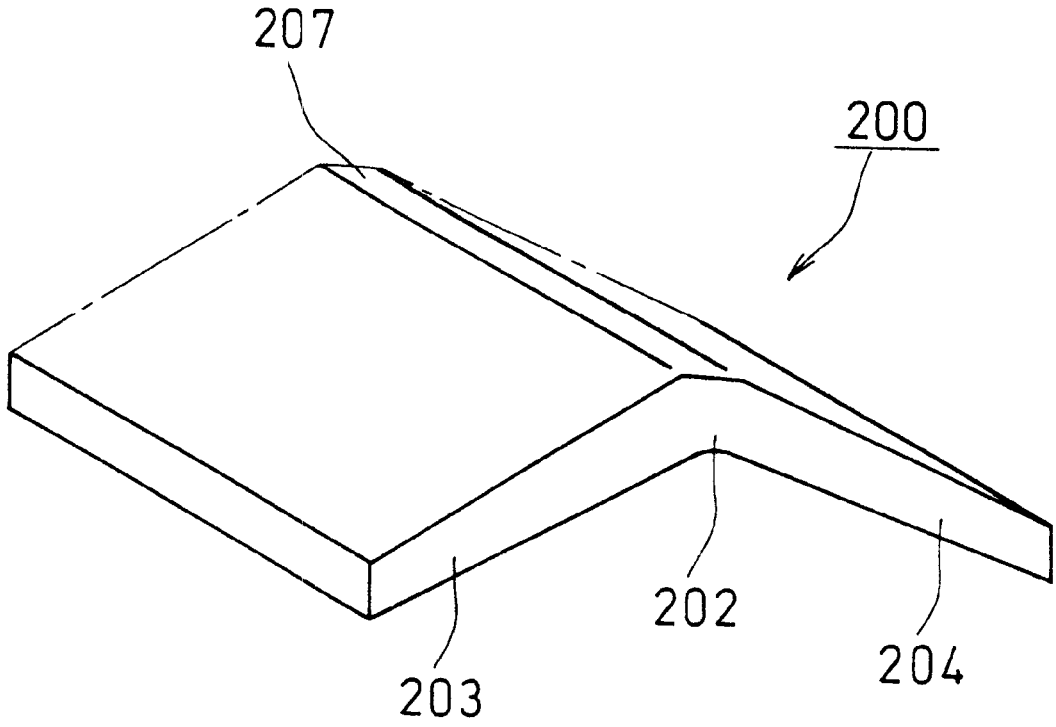
FIG. 7 is a perspective view showing a state wherein the strip plate material shown in FIG. 5 further is bent and deformed.

In the roll forming step, pressure rollers are brought into contact with the lower surface of the middle part 202 provided with the thick stripe portion 208 and the upper surfaces of the thickness-deviation portions 203, 204, respectively, and the middle part 202 is bent gradually, centered on the recessed portion 207 of the thick stripe portion 208. As a result, the left and right protruding stripes 205, 206 of the thick stripe portion 208 are subjected to pulling forces in the directions away from each other. Consequently, as shown in FIGS. 6 and 7, the protruding stripes 205, 206 gradually come to have gentle slopes and on the other hand, the recessed portion 207 rises up, thus obtaining a smooth form as a whole. Then, the strip plate material 200 is bent and deformed to have a desired bending angle, thus forming a member with a substantially L-shaped cross-section.

When a tapered face 123 shown in FIG. 3 is to be formed at the end of a thickness-deviation portion in its width direction, it also can be formed in the roll forming step. In this case, a cutting blade or a finishing roller is brought into contact with the end face utilizing the force with which the plate is forced out in the roll forming, thus forming the end face of the thickness-deviation portion including the tapered face 123 during the processing of the plate.

The supporter 121 according to the present embodiment thus obtained is formed so that the portions extending continuously from the bent and deformed portion are reduced in thickness gradually toward their ends to be thinner than an original thickness of the steel plate. Thus, the supporter is lighter than one obtained by a conventional manufacturing method. On the other hand, the bent and deformed portion itself maintains a sufficient thickness and therefore the supporter has substantially no difference in strength compared to the conventional one.

Heights of the respective protruding stripes 205, 206 from the upper surfaces of the thickness-deviation portions 203, 204, an interval between the protruding stripes 205, 206, a depth of the recessed portion 207, and the like are set suitably according to an elongation percentage of the plate, a bending angle, a curvature of the bent and deformed portion, or the like, and the positions, contact angles, and the like of the rollers in the rolling step are determined accordingly.

SECOND EMBODIMENT

A color cathode-ray tube according to a second embodiment has the same configuration as that according to the first embodiment except for the supporters for stretching a shadow mask.

A supporter according to the second embodiment is obtained using a strip-like steel material with a substantially uniform thickness as a raw material by rolling and roll forming as in the first embodiment, which are carried out sequentially as shown in FIG. 4.

Figure 9:
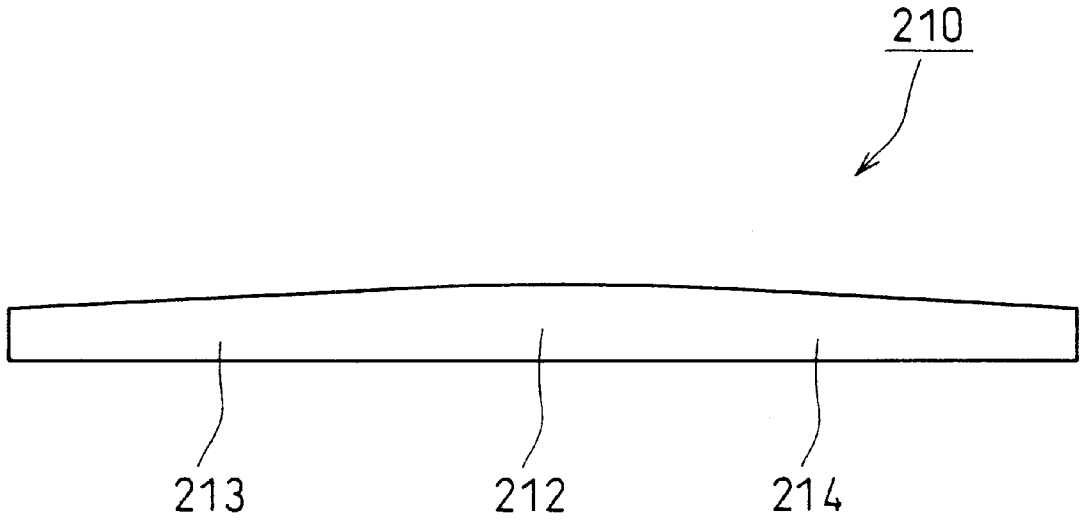
FIG. 9 is an end view of a strip plate material according to a second embodiment of the present invention.
Figure 10:
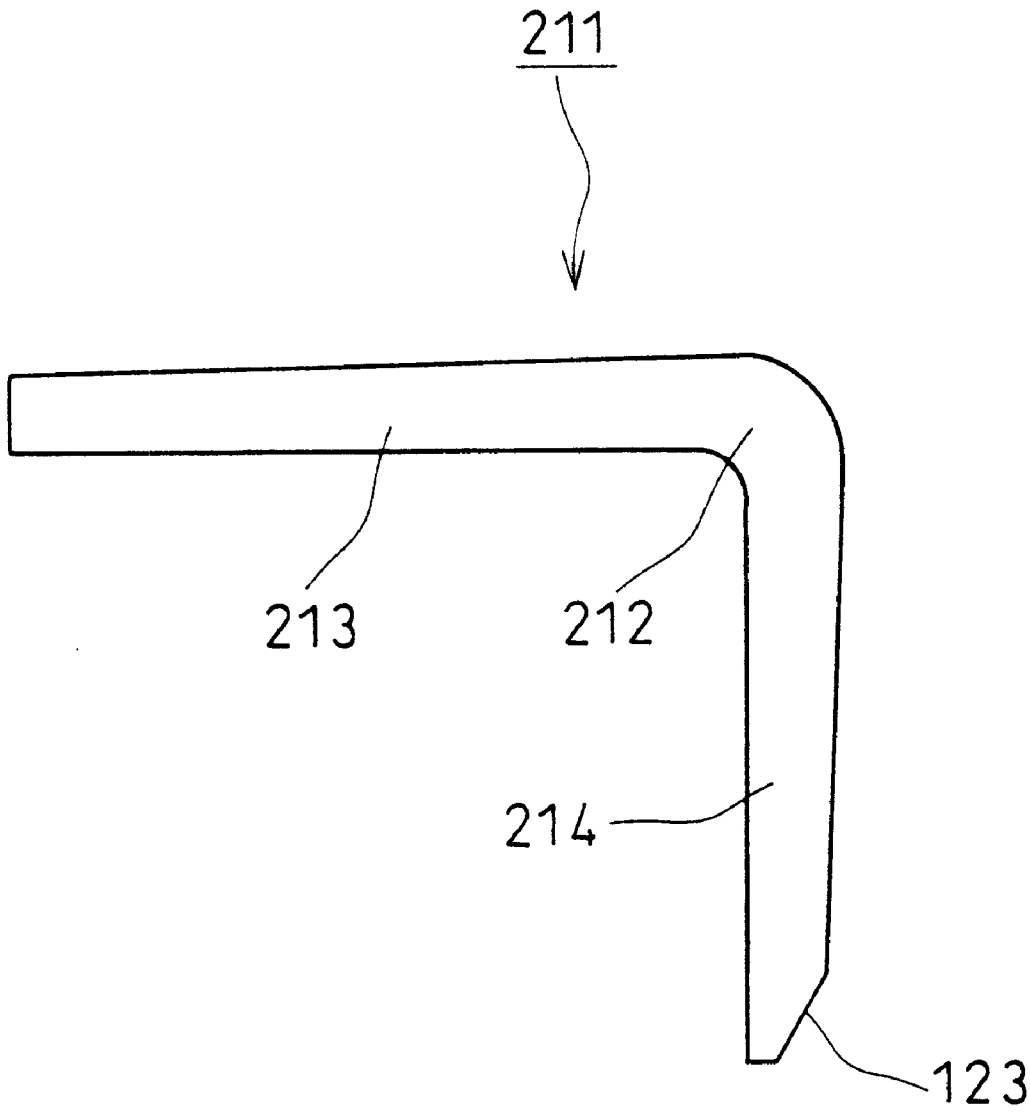
FIG. 10 is an end view of a supporter obtained after completion of roll forming according to the second embodiment of the present invention.

FIG. 9 is an end view of a strip plate material according to the second embodiment of the present invention after the rolling step. FIG. 10 is an end view of a supporter according to the second embodiment obtained by allowing the strip plate material shown in FIG. 9 to be bent by roll forming.

As shown in FIG. 9, a strip plate material 210 is formed to have an upper surface shown in the figure with gentle downward slopes from a middle part 212 toward both side ends, respectively, thus forming thickness-deviation portions 213, 214 on the left and right sides of the middle part 212. This embodiment is different from the first embodiment in that the middle part 212 is provided with no thick stripe portion. The strip plate material 210 may be formed by a rolling step as in the first embodiment.

The strip plate material 210 is bent and deformed by roll forming with the center of the middle part 212 being set as the bending center, thus obtaining a supporter 211 with a substantially L-shaped cross-section with an outer corner of the bent and deformed portion having substantial roundness as shown in FIG. 10. In this case, as in the first embodiment, a tapered face 123 may be formed at the end of the thickness-deviation portion 214.

The supporters 211 thus obtained can be used as substitutes of the supporters 121*a*, 121*b* of the color cathode-ray tube shown in FIGS. 1 to 3 according to the first embodiment.

Since the middle part 212 having no thickness deviation is set to be the bent and deformed portion in the supporter 211, the same strength as that of a conventional product is maintained, and the reduced weight of the thickness-deviation portions 213, 214 allows the product obtained in the present embodiment as a whole to be lighter.

THIRD EMBODIMENT

A color cathode-ray tube according to a third embodiment has the same configuration as that in the first embodiment except for the supporters for stretching a shadow mask.

A supporter according to the third embodiment is obtained using a strip-like steel material with a substantially uniform thickness as a raw material by rolling and roll forming as in the first embodiment, which are carried out sequentially as shown in FIG. 4.

Figure 11:
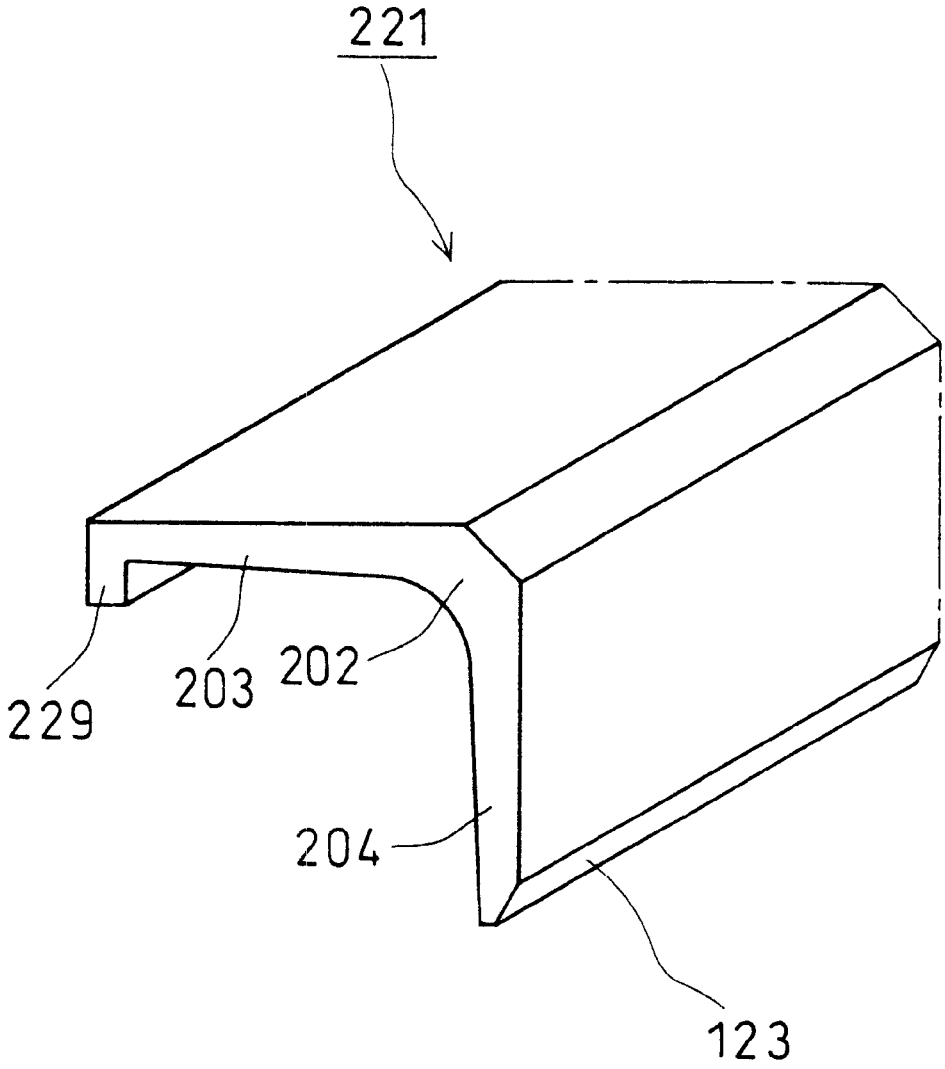
FIG. 11 is a perspective view of a supporter according to a third embodiment of the present invention.

FIG. 11 is a perspective view of a supporter 221 with a substantially L-shaped cross-section according to the third embodiment. In FIG. 11, numeral 202 indicates a bent and deformed portion (a middle part), and numerals 203 and 204 denote thickness-deviation portions formed on both sides of the bent and deformed portion 202. In this case, the strip plate material 200 (see FIG. 5) according to the first embodiment obtained through the rolling step was used and was processed through the roll forming as in the first embodiment, thus obtaining the supporter 221 shown in FIG. 11. In the third embodiment, in addition to the formation of the tapered face 123 at the end of the thickness-deviation portion 204 in the roll forming step, further a protruding portion 229 is formed at the end of the thickness-deviation portion 203. The protruding portion 229 is formed substantially in parallel to the thickness-deviation portion 204 and extends in the same direction as the thickness-deviation portion 204 extends with respect to the thickness-deviation portion 203. In this case, a roller is brought into contact with the end of the thickness-deviation portion 203 in the roll forming as in the case of forming the tapered face 123, thus forming the protruding portion 229 concurrently with the formation of the bent and deformed portion.

The supporters 221 thus obtained can be used as substitutes of the supporters 121*a*, 121*b* in the color cathode-ray tube as shown in FIGS. 1 to 3 according to the first embodiment.

Figure 12:
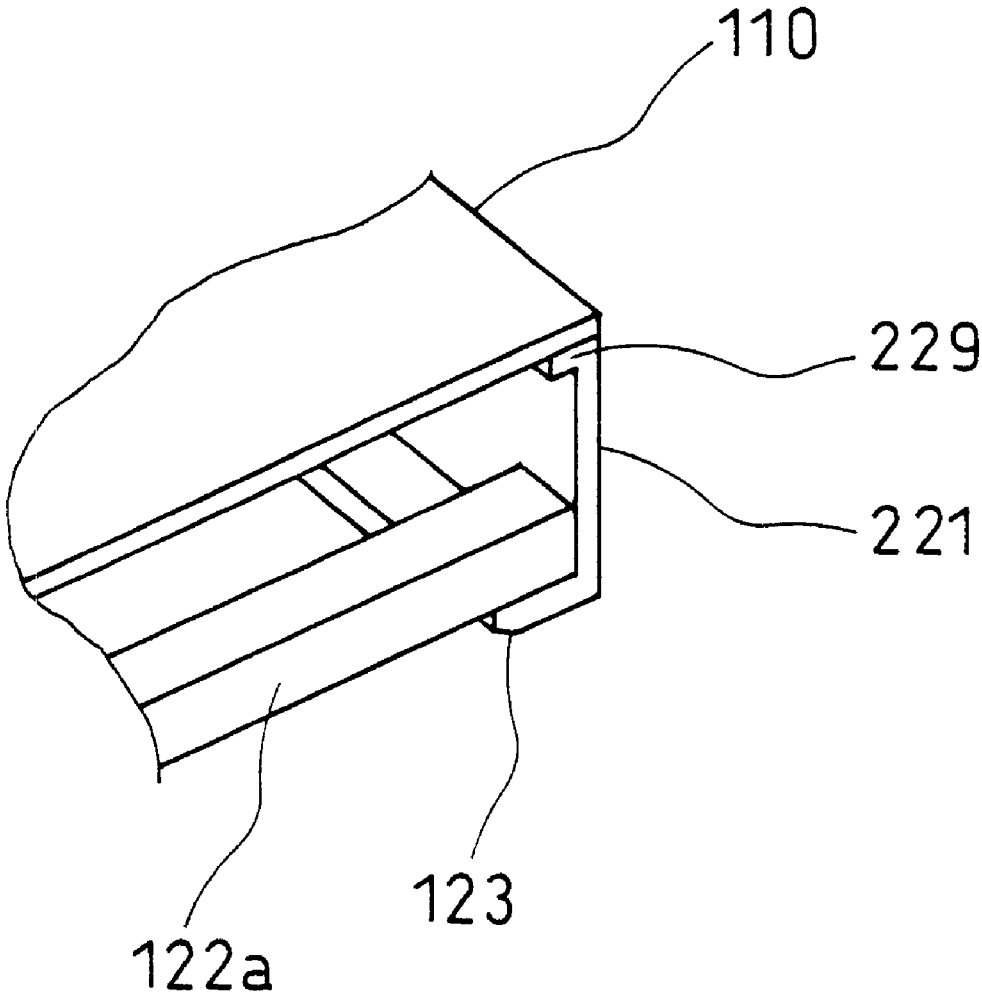
FIG. 12 is an enlarged perspective view showing a portion where the supporter and a shadow mask are attached to each other in a color cathode-ray tube according to the third embodiment of the present invention.

FIG. 12 is a partially enlarged perspective view of a mask structure using the supporter 221 of the third embodiment. As shown in the figure, the shadow mask 110 is stretched on a side face of the protruding portion 229. According to this configuration, the area where the shadow mask 110 and the supporter 221 are in contact with each other increases and therefore lines of magnetic force caused by geomagnetism or the like entering in a direction of the tube axis of the cathode-ray tube tend to pass easily, thus reducing magnetic resistance. Consequently, electron beams tend not to be affected by the lines of magnetic force easily when passing through the shadow mask, thus suppressing the shift in electron beam landing positions. As a result, a color cathode-ray tube causing less color unevenness can be obtained.

The protruding portion 229 is not limited to one having the shape shown in FIGS. 11 and 12 as long as it is obtained by a process in which the end of the thickness-deviation portion is formed so that the protruding portion 229 is wider than the thickness of the thickness-deviation portion and its tip is a flat surface. For example, the protruding portion 229 may be formed to extend to the opposite side to the side on which the thickness-deviation portion 204 extends with respect to the thickness-deviation portion 203 or may be formed to extend to both sides of the thickness-deviation portion 203 so as to form a substantially T-shaped cross-section.

The above-mentioned first to third embodiments are directed to the examples in which a shadow mask is stretched on supporters placed in the direction of the long sides of a mask frame. However, the present invention is not limited to color cathode-ray tubes with such a configuration.

For instance, the present invention also can be applied to a color cathode-ray tube with a mask structure in which a shadow mask is stretched on supporters placed in the direction of short sides of a mask frame while tensile force is applied to the directions of its long sides. In this case, as the supporters for stretching the shadow mask, the supporters according to the above-mentioned first to third embodiments can be used.

Figure 13:
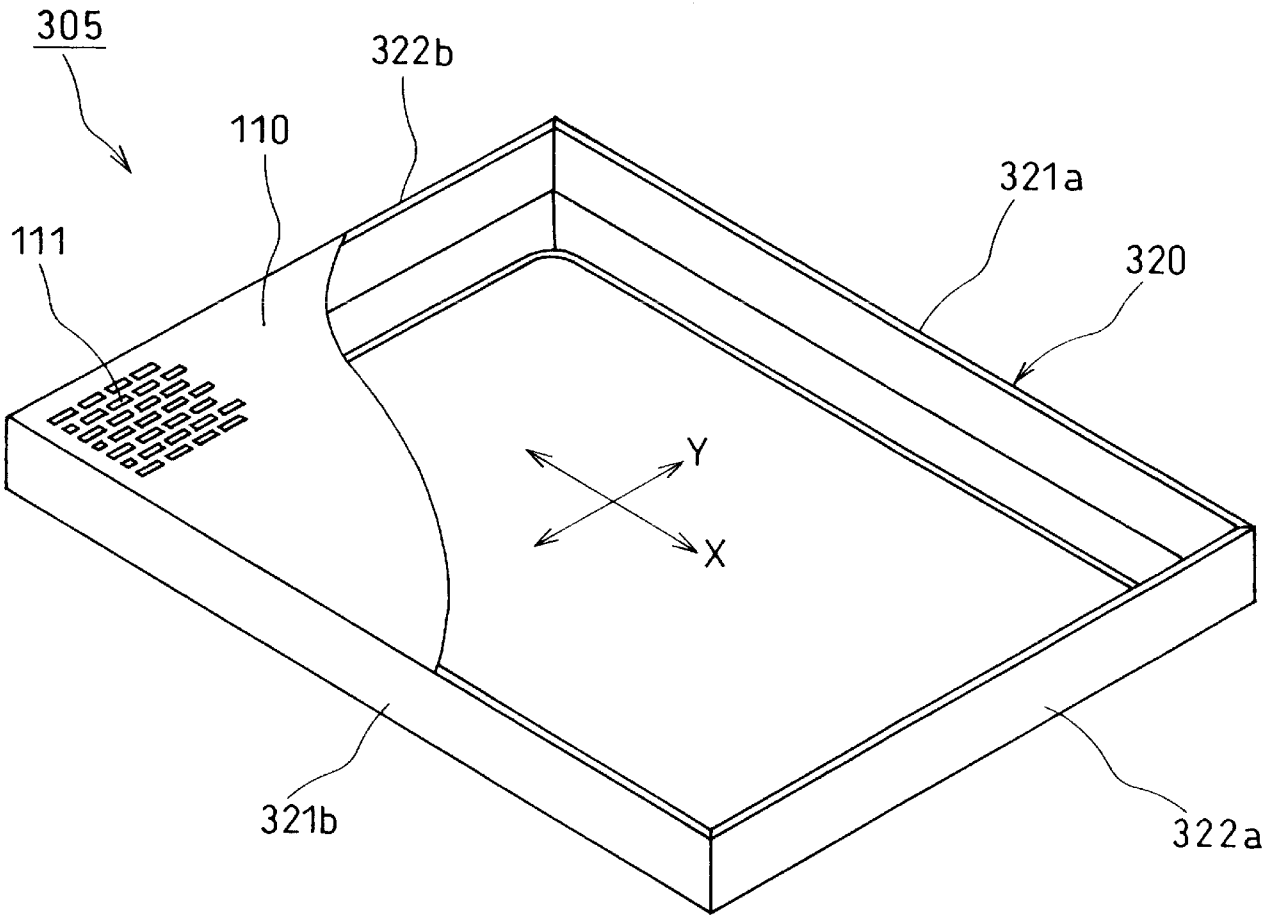
FIG. 13 is a schematic perspective view showing a mask structure in which a shadow mask is stretched and held by four sides.

Alternatively, the present invention also can be applied to a color cathode-ray tube with a mask structure 305 in which a shadow mask 110 is stretched on a mask frame 320 formed of supporters 321*a*, 321*b* placed in the long side direction and supporters 322*a*, 322*b* placed in the short side direction that are combined to have a rectangular shape while tensile forces are applied in the long side direction X and the short side direction Y, as shown in FIG. 13. In this case, as the supporters 321*a*, 321*b*, 322*a*, and 322*b*, the supporters according to the above-mentioned first to third embodiments can be used.

In the manufacture of the supporters, it is not always necessary to form two protruding stripes in the thick stripe portion of the strip plate material as shown in the first embodiment. According to the curvature or size of the bent and deformed portion, a single or a plurality of protruding stripes may be formed.

In the above-mentioned embodiments, the tapered face and the protruding portion were formed in the roll forming step, but may be formed in the rolling step for forming the thickness-deviation portions by the same methods as described above.

In addition, a tapered face or a protruding portion to be formed at the end of a supporter in its width direction can be provided at a required end as required. The side on which the tapered face is to be formed, the slope angle of the tapered face, the size of the protruding portion, the direction in which the protruding portion protrudes, or the like can be changed suitably.

In the first to third embodiments, the rolling and the roll forming were carried out sequentially with respect to a steel material with a substantially uniform thickness to obtain a supporter with a substantially L-shaped cross-section, but the present invention is not limited thereto. That is to say, the rolling and the roll forming can be carried out at substantially the same time with respect to the steel material with a substantially uniform thickness to form a bent and deformed portion in the middle part of the steel material while thickness-deviation portions are formed on both sides of the middle part in the width direction of the steel material. This allows the forming steps to be simplified and the bent and deformed portion to be formed using the processing heat generated during the formation of the thickness-deviation portions effectively.

EXAMPLE

Figure 14:
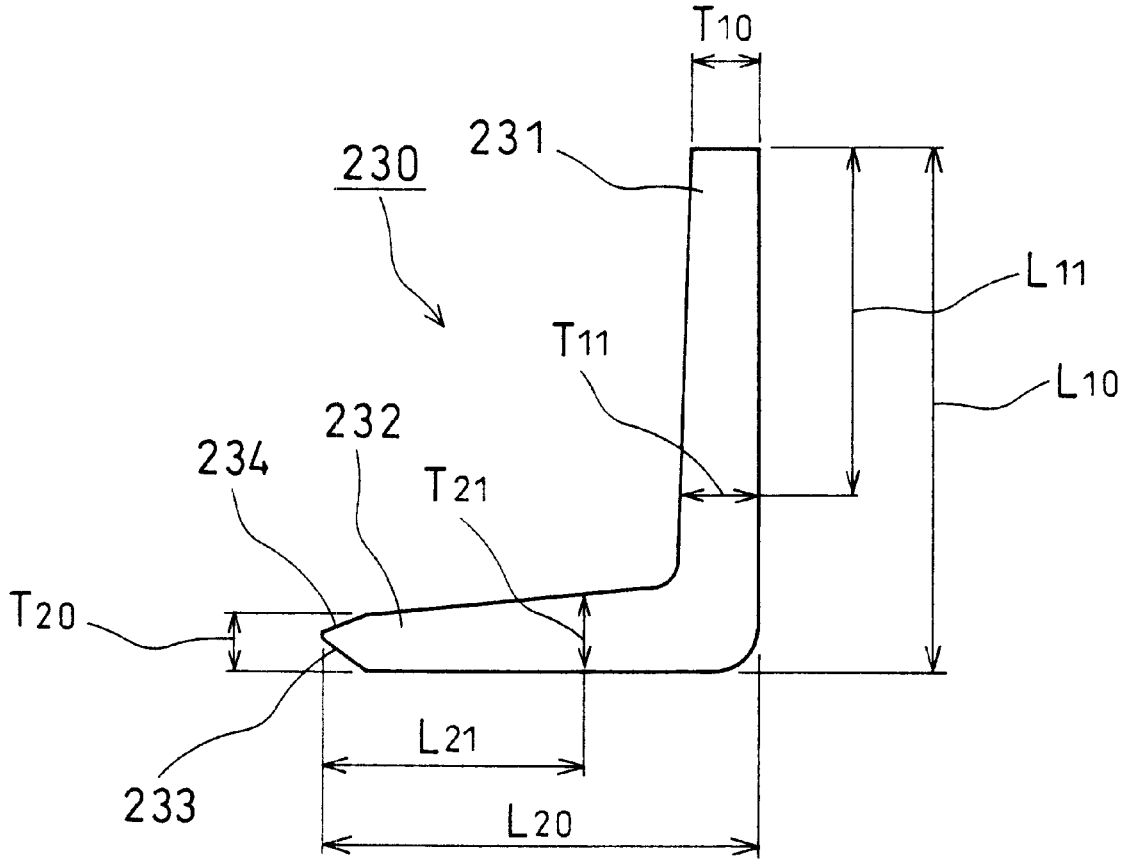
FIG. 14 is a sectional view of a supporter according to an example.

Assuming a color cathode-ray tube with a 25-inch diagonal size in which a shadow mask was stretched on supporters placed in a long side direction (with a stretching tensile force of the shadow mask of 8.33 N (850 kgf) with respect to overall width), a supporter 230 (the present invent) was produced by the method according to the second embodiment. FIG. 14 shows a sectional shape of the supporter 230. The shadow mask is stretched on the end 231 side. At the other end 232, tapered faces 233, 234 are formed on both sides. The tapered faces 233, 234 were provided in the roll forming step for forming a bent and deformed portion. The dimensions shown in the figure are as follows: L10=30 mm, L11=20.5 mm, L20=25 mm L21=15.5 mm, T10=3.57 mm, T11=4.5 mm, T20=3.8 mm, and T21=4.5 mm (design values). The overall length of the supporter 230 is 467 mm. The material used herein was a hot rolled material of chrome molybdenum steel with a thickness of 5.0 mm.

Figure 15:
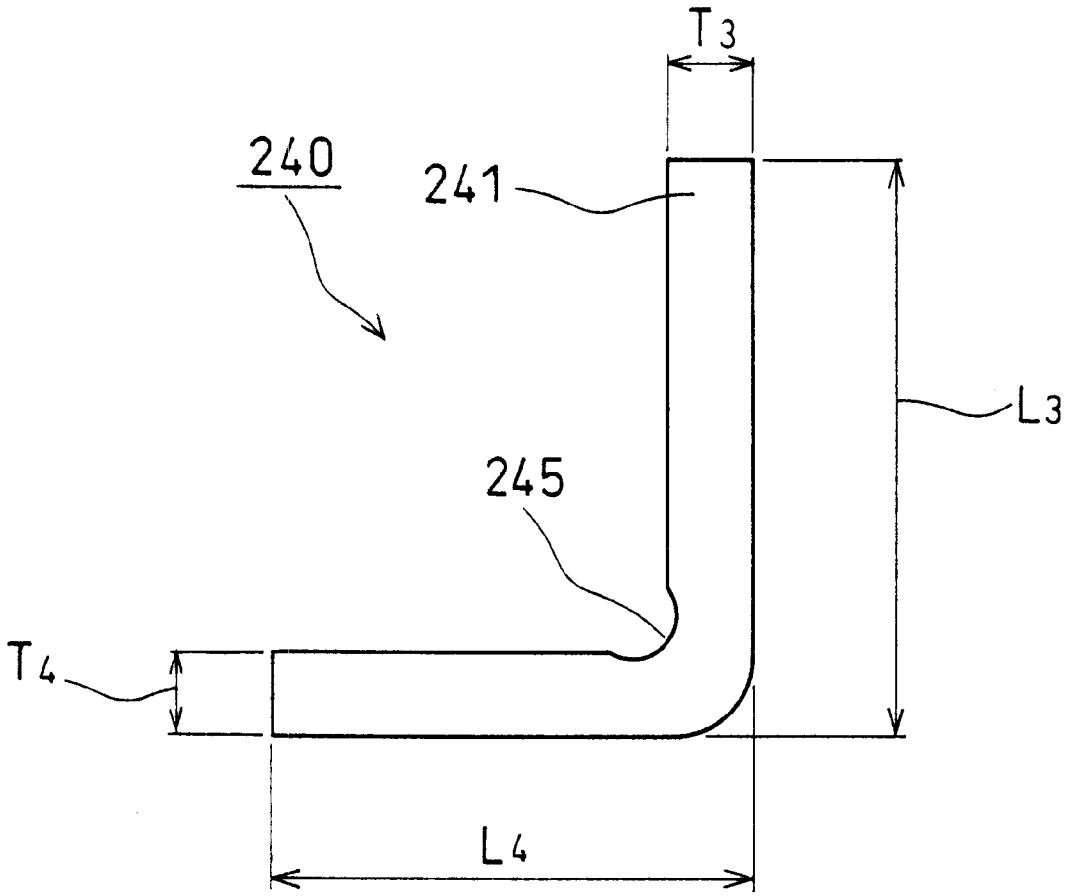
FIG. 15(PRIOR ART)
FIG. 15 is a sectional view of a supporter according to a comparative example.

As a comparative example, assuming the same color cathode-ray tube with a 25-inch diagonal size as that described above, a supporter 240 (a conventional product) was produced using a strip-like hot rolled material of the same material as described above with a thickness of 4.5 mm by the same press processing as in the conventional method. FIG. 15 shows a sectional shape of the supporter 240. The shadow mask is stretched on the end 241 side. The sizes shown in the figure are as follows: L3=30 mm, L4=25 mm, T3=4.5 mm, and T4=4.5 mm (design values). As shown in the figure, the inner side of a bent and deformed portion 245 was recessed due to the contact of a tool during the press processing, thus causing so-called "thickness loss". The bent and deformed portion 245 subjected to the thickness loss had a thickness of about 4 mm. The overall length of the supporter 240 was 467 mm.

The above-mentioned supporters 230 and 240 were evaluated as follows.

Weight

The weight of the respective supporters was measured.

Deformation (Stiffness)

Figure 16:
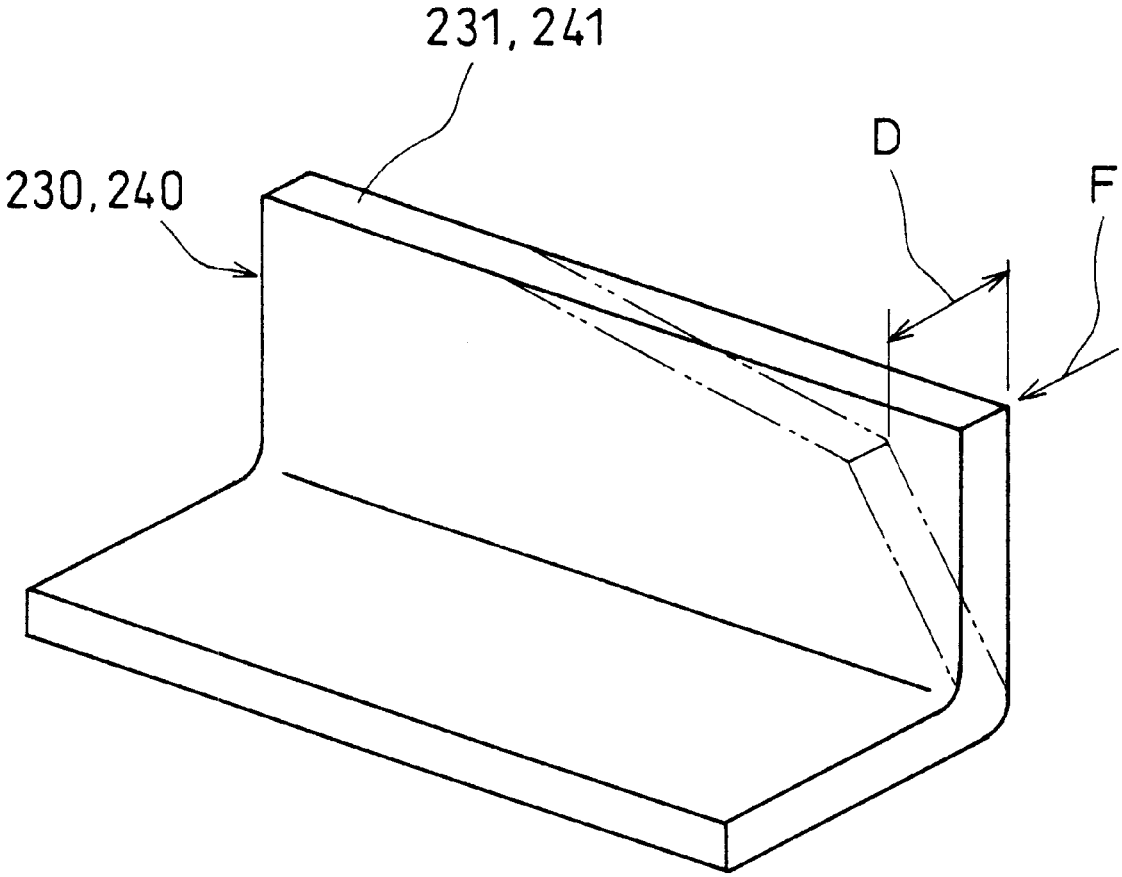
FIG. 16 is a perspective view showing a method of measuring deformation of a supporter.

As shown in FIG. 16, the surfaces of the supporters 230 and 240 on the opposite side to the side on which the shadow mask was stretched were fixed to a horizontal plane, a horizontal direction load F of 784 N (80 kgf) was applied to the ends 231, 241 on the side on which the shadow mask was stretched, and then the displacement D at the point to which the load F was applied was measured. The measurement was carried out at two points, the center and the end in the longitudinal direction of each supporter.

Thickness Variation

The plate thickness T11 (see FIG. 14) and T3 (see FIG. 15) on the side on which the shadow mask was stretched were measured along the longitudinal direction. According to the measurement results, the variations with respect to the design values (4.5 mm in both cases) were determined.

The evaluation results are shown in Table 1.

TABLE 1

| | Present Invent (Supporter 230) | Conventional Product (Supporter 240) |
|---|---|---|
| Weight (g) | 885 | 942 |
| Deformation (mm) | | |
| Center | 0.41 | 0.55 |
| End | 0.64 | 0.78 |
| Thickness Variation (mm) | ±0.023 | ±0.18 |

As is apparent from Table 1, although the supporter 230 according to the present invention is lightened by about 6% as compared to the supporter 240 of the comparative example, the deformation is reduced by about 20% (i.e. the stiffness is improved by about 20%). This is because the bent and deformed portion of a stress concentration portion of the present invent is thicker and the flat plate portions on both sides of the bent and deformed portion in the present invent are formed to be thinner as compared to those in the conventional product.

Since the weight of the supporter can be reduced, the weight of the mask structure 105 can be reduced, thus preventing color unevenness from occurring due to the deformation of the elastic supporters 129 caused by a shock when a color cathode-ray tube collides with something or is dropped during transportation or by the heaviness of the mask structure 105.

The thickness variation in the present invent is reduced considerably as compared to that in the conventional product, although hot rolled materials are used for both the present invent and the conventional product. The thickness variation relates closely to the variation in strength of the supporter and further to the variation in tensile force applied to the shadow mask stretched on the supporter. Therefore, when the variation in the thickness of the supporter can be reduced, the variation in the tensile force applied to the shadow mask stretched thereon also can be reduced. Deviation of the tensile force applied to the shadow mask from a design value causes deterioration in the damping of vibration generated in the shadow mask and reduction in the effect of preventing doming, both of which cause the shift of electron beam landing positions, thus causing color unevenness. The present invent has a smaller thickness variation and thus, a color cathode-ray tube having stable qualities and causing less color unevenness can be provided.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode-ray tube, comprising:

a mask frame with at least a pair of opposed supporters, which is formed in a substantially rectangular frame shape; and a shadow mask functioning as a color selection electrode stretched and held by the supporters while being provided with a tensile force, wherein each of the pair of opposed supporters is a member with a substantially L-shaped cross-section and is obtained by:

forming of a strip plate material having a middle part and thinner thickness-deviation portions on both sides of the middle part by rolling of a metal material; and then bending and deforming of the strip plate material in its width direction by roll forming to form a bent and deformed portion in the middle part.

2. A color cathode-ray tube, comprising:

a mask frame with at least a pair of opposed supporters, which is formed in a substantially rectangular frame shape; and a shadow mask functioning as a color selection electrode stretched and held by the supporters while being provided with a tensile force, wherein each of the pair of opposed supporters is a member with a substantially L-shaped cross-section and is obtained by:

forming of a strip plate material by rolling of a metal material, the strip plate material having a middle part, thinner thickness-deviation portions on both sides of the middle part, and a thick stripe portion at a predetermined position in the middle part corresponding to an outer corner of a bent and deformed portion to be formed; and then bending and deforming of the strip plate material in its width direction at a position of the thick stripe portion by roll forming to form the bent and deformed portion.

3. A color cathode-ray tube, comprising:

a mask frame with at least a pair of opposed supporters, which is formed in a substantially rectangular frame shape; and a shadow mask functioning as a color selection electrode stretched and held by the supporters while being provided with a tensile force, wherein each of the pair of opposed supporters is a member with a substantially L-shaped cross-section and is obtained by a process in which while thinner thickness-deviation portions are formed on both sides of a middle part of a metal material by rolling of the metal material, the metal material is bent and deformed in its width direction by roll forming to form a bent and deformed portion in the middle part.

4. A color cathode-ray tube, comprising:

a mask frame with at least a pair of opposed supporters, which is formed in a substantially rectangular frame shape; and a shadow mask functioning as a color selection electrode stretched and held by the supporters while being provided with a tensile force, wherein each of the pair of opposed supporters is a member with a substantially L-shaped cross-section and is obtained by a process in which while rolling a metal material to form thinner thickness-deviation portions on both sides of a middle part of the metal material and a thick stripe portion at a predetermined position in the middle part corresponding to an outer corner of a bent and deformed portion to be formed, the metal material is bent and deformed in its width direction at a position of the thick stripe portion by roll forming to form the bent and deformed portion.

5. The color cathode-ray tube according to claim 2, wherein the thick stripe portion has two adjacent protruding stripes extending continuously in a length direction, and a portion between the two adjacent protruding stripes is recessed in an arc shape.

6. The color cathode-ray tube according to claim 1, wherein the rolling of a metal material is carried out under ordinary temperature, and the roll forming is carried out while processing heat generated in the rolling under ordinary temperature is maintained in the strip plate material.

7. The color cathode-ray tube according to claim 1, wherein the supporter has a tapered face and/or a protruding portion at an end in its width direction and the tapered face and/or the protruding portion are/is formed by the rolling or the roll forming.

8. The color cathode-ray tube according to claim 1, wherein the pair of supporters form long sides of the mask frame and the shadow mask is provided with a tensile force in its short-side direction.

9. The color cathode-ray tube according to claim 4, wherein the thick stripe portion has two adjacent protruding stripes extending continuously in a length direction, and a portion between the two adjacent protruding stripes is recessed in an arc shape.

10. The color cathode-ray tube according to claim 2, wherein the rolling of a metal material is carried out under ordinary temperature, and the roll forming is carried out while processing heat generated in the rolling under ordinary temperature is maintained in the strip plate material.

11. The color cathode-ray tube according to claim 2, wherein the supporter has a tapered face and/or a protruding portion at an end in its width direction and the tapered face and/or the protruding portion are/is formed by the rolling or the roll forming.

12. The color cathode-ray tube according to claim 3, wherein the supporter has a tapered face and/or a protruding portion at an end in its width direction and the tapered face and/or the protruding portion are/is formed by the rolling or the roll forming.

13. The color cathode-ray tube according to claim 4, wherein the supporter has a tapered face and/or a protruding portion at an end in its width direction and the tapered face and/or the protruding portion are/is formed by the rolling or the roll forming.

14. The color cathode-ray tube according to claim 2, wherein the pair of supporters form long sides of the mask frame and the shadow mask is provided with a tensile force in its short-side direction.

15. The color cathode-ray tube according to claim 3, wherein the pair of supporters form long sides of the mask frame and the shadow mask is provided with a tensile force in its short-side direction.

16. The color cathode-ray tube according to claim 4, wherein the pair of supporters form long sides of the mask frame and the shadow mask is provided with a tensile force in its short-side direction.

* * * * *